US006860184B1

(12) United States Patent
Chen et al.

(10) Patent No.: US 6,860,184 B1
(45) Date of Patent: Mar. 1, 2005

(54) FILM CUTTER

(75) Inventors: Kuo-Raid Grant Chen, Cary, NC (US); Adam Whitaker Duncan, Clayton, NC (US)

(73) Assignee: Axon Corporation, Raleigh, NC (US)

( * ) Notice: Subject to any disclaimer, the term of this patent is extended or adjusted under 35 U.S.C. 154(b) by 12 days.

(21) Appl. No.: 10/411,717

(22) Filed: Apr. 12, 2003

(51) Int. Cl.[7] ..... B26D 5/08
(52) U.S. Cl. ..... 83/582; 83/607; 83/694
(58) Field of Search ..... 83/694, 640, 641, 83/607, 608, 609, 582, 583, 636, 623, 699.11, 557

(56) References Cited

U.S. PATENT DOCUMENTS

| | | | | | |
|---|---|---|---|---|---|
| 950,099 | A | * | 2/1910 | Fischer | 83/607 |
| 1,992,539 | A | * | 2/1935 | Munschauer | 83/694 |
| 3,738,213 | A | | 6/1973 | Fairbanks | 83/589 |
| 3,893,361 | A | | 7/1975 | Harris | 83/375 |
| 4,398,441 | A | * | 8/1983 | Jue | 83/607 |
| 4,476,760 | A | | 10/1984 | Block et al. | 83/582 |
| 4,909,109 | A | * | 3/1990 | Crane | 83/694 |
| 5,000,070 | A | | 3/1991 | Ozawa et al. | 83/582 |
| 5,237,901 | A | | 8/1993 | Warga, III | 83/583 |
| 5,970,748 | A | * | 10/1999 | Nickey et al. | 83/623 |
| 6,012,371 | A | * | 1/2000 | Nishigaki | 83/698.11 |

* cited by examiner

*Primary Examiner*—Stephen Choi
(74) *Attorney, Agent, or Firm*—Michael R. Philips

(57) ABSTRACT

A film cutter is provided for use in an industrial process in which a vertical blade and a horizontal blade interact. The vertical blade is mounted to move slidingly in a vertical plane and an end of the vertical blade rests upon the horizontal blade. The horizontal blade is mounted at an acute angle to the vertical blade. In the cutting process, the horizontal blade is moved in a direction that is perpendicular to the vertical blade so as to maintain the acute angle between the cutting edges substantially constant while the cutting intersection moves along the blade length.

9 Claims, 2 Drawing Sheets

FILM CUTTER

FIELD OF THE INVENTION

The present invention relates to the field of cutting devices and more particularly to a cutting device in which two blades are oriented with respect to each other to move in orthogonal planes.

BACKGROUND OF THE INVENTION

The invention disclosed herein provides a film cutter particularly suited for cutting film in a production machine environment. Film, specifically plastic polymer film, is frequently difficult to cut, especially by a mechanical cutter device. This film cutting difficulty is because in relatively thin cross section plastic film is typically flexible, and in relatively thick cross section plastic film is often somewhat tough. Also, plastic film tends to wear a cutting edge, making intimate alignment a priority. In addition, such a mechanical production cutter is subject to wear of its cutting edge due to substantially continuous use.

Numerous patents have been issued for devices used to cut material, e.g. plastic film, in a production machine environment. U.S. Pat. No. 4,476,760 to Block et al. is for a Cutting System in which a lower blade is stationary and an upper blade is movably mounted to a pivot rod. As the upper blade is rotated downward, a pressure arm acts against any tendency for the upper blade to align its cutting edge with the cutting edge of the lower blade and to provide a firm cutting pressure at a cutting point that moves continually along the blade length. U.S. Pat. No. 5,000,070 to Ozawa et al. is for a Cutter for cutting a thin material by a movable blade and a fixed blade in which a spring member is disposed between the movable blade and a movable base for moving the movable blade in the direction of engagement to bring the movable blade into contact with the fixed blade. U.S. Pat. No. 5,237,901 to Warga is for a Shear having a dual compensating link arrangement operatively associated with one of two blades. The blades may be oriented angularly with respect to one another and the angle adjusted to alter a horizontal force that counteracts a separation force during a cutting stroke. A preload bias is provided to urge the blades together during the cutting stroke so as to minimize the gap between the cutting blades.

The present invention, however, incorporates a combination of features not found in the prior art, as will be described below.

It is an object of the present invention to provide a film cutter for use in a machine production environment wherein the film is cut by the engagement of two cutting blades that maintain intimate engagement with one another for an extended service life.

This and other objects will become more apparent from the description of the invention to follow.

SUMMARY OF THE INVENTION

The invention disclosed herein provides a cutting device that is particularly adapted for cutting film in a production environment involving continuous mechanical operation. While the invention described is useful in cutting polymer films, it is also recognized that the principles of the invention may be applied to cutting cloth or paper, among other thin section materials. The film cutter has two blades that are oriented orthogonal to one another so as to engage and cut a vertically oriented film along a cutting plane. A vertically movable blade is mounted for unidirectional motion and biased in a direction to maintain contact with a horizontally movable blade. An extended platform section of the horizontal blade supports the vertical blade to prevent the biased vertical blade from colliding with the moving horizontal blade, while enabling optimum cutting edge contact. The horizontally movable blade is moved mechanically across a cutting edge of the vertical blade. The cutting edge of the horizontal blade is preferably oriented at an acute angle to the cutting edge of the vertical blade, and the movement of the horizontal blade is normal to the cutting edge of the vertical blade. As the horizontal blade moves horizontally, the vertical blade maintains intimate contact at the cutting plane, providing a reliable cutting action and edge honing throughout an extended useful blade life.

DETAILED DESCRIPTION OF THE INVENTION

Figure 1:
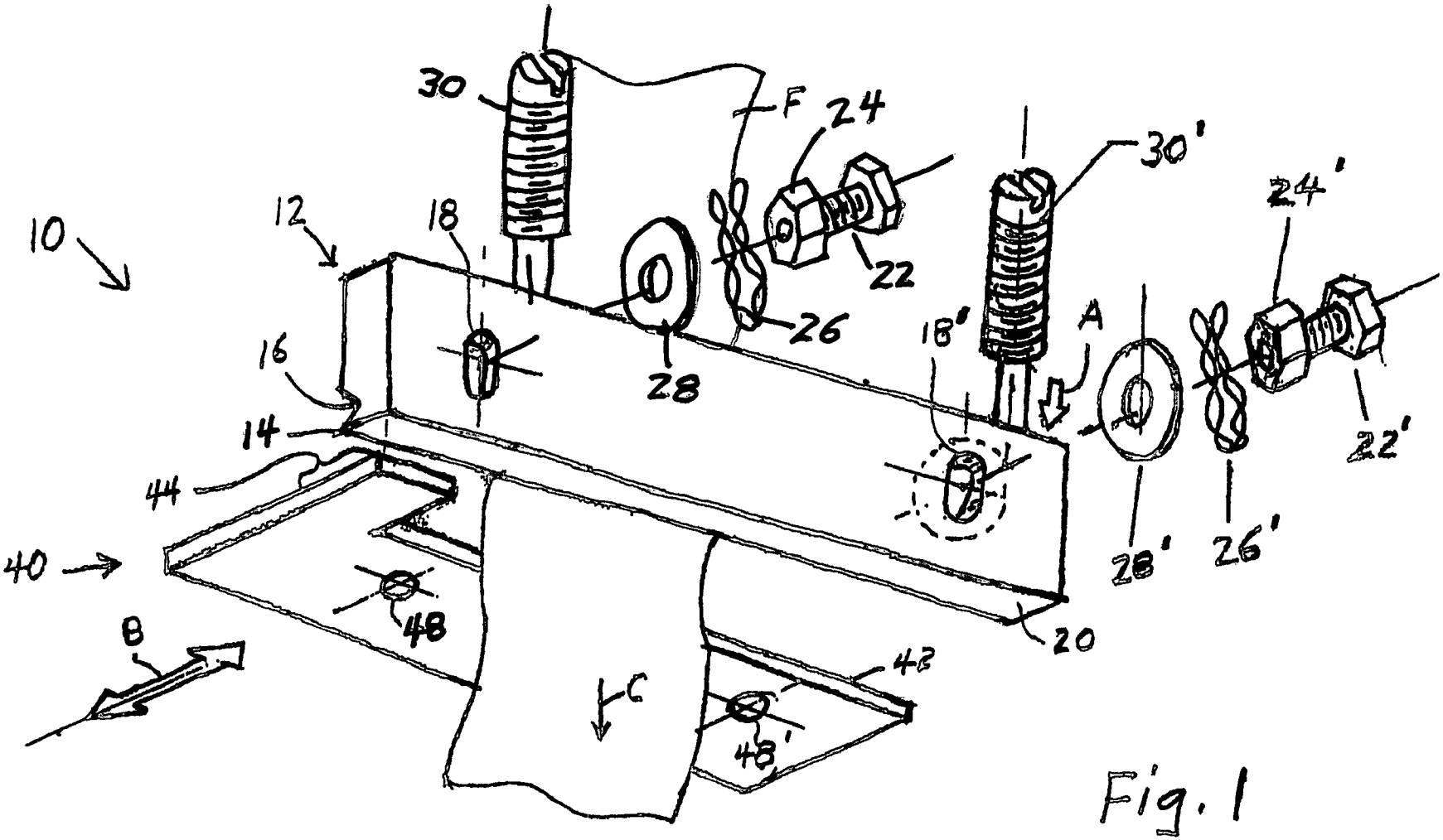
FIG. 1 is a perspective exploded view of the main components of the film cutter of the present invention.

A film cutter 10 according to the present invention is shown from below in perspective view in FIG. 1. Film F is intermittently moved downwardly along a film path of travel generally in the direction indicated by arrow C to pass between vertical blade 12 and horizontal blade 40. In the preferred embodiment of the invention, film F is moved downward by film driving means (not shown) from a film supply that resides outside the range of the drawing figure. Driving film F from above maintains a film flow so that when a lower portion of film F is severed from the upper portion, drive means contact is maintained. Depending on the material of the film or its dimensions, a guide may be provided adjacent the cutting blades to keep the film moving in the desired direction.

Vertical blade 12 is positioned above an extended portion of horizontal blade 40 and rests thereon. Vertical blade 12 is mounted to a support member (not shown) by a plurality of fasteners, for example bolts 22 and 22', that are each inserted through one of vertically oriented slots 18, 18' so that vertical blade 12 is guided to move substantially exclusively in a vertical plane. In order to substantially minimize horizontal movement of vertical blade 12, since such movement would be detrimental to the cutting action desired, bolts 22, 22' are fitted with locking nuts 24, 24' that are positioned to bear against spring washers 26, that, in turn, bear against flat washers 28, 28'. By proper adjustment of locking nuts 24, 24' to cause flat washers 28, 28' to slidingly contact vertical blade 12 without binding, vertical blade 12 can freely move up and down linearly. Vertical blade 12 is biased downward in the preferred embodiment through the addition of biasing means, for example a spring plunger 30, 30' as is known at either end of vertical blade 12. Vertical blade 12 maintains substantially floating contact upon horizontal blade 40. In an alternate embodiment of the invention, vertical blade 12 is maintained in contact with horizontal blade 40 simply through the biasing action of gravity. In another embodiment, a single spring plunger, preferably spring plunger 30' at the right end (as illustrated) of vertical blade 12, is used. In all cases, especially the two spring plunger 30, 30' preferred embodiment, the floating contact of vertical blade 12 on horizontal blade 40 results in a honing action to continuously sharpen the mating cutting edges. If a single spring plunger 30 is employed, the end of vertical blade 12 supporting spring plunger 30 will be forced downwardly relative to the opposite end thereof. The two spring plungers 30, 30' may be adjusted to create a different degree of downward pressure on vertical blade 12, or they both apply substantially the same pressure.

Horizontal blade 40 is positioned lower than vertical blade 12 and located so that a portion of bearing surface 20 of vertical blade 12 sets upon an extended platform 44 of horizontal blade 40. Horizontal blade 40 is rigidly held in a horizontal plane by being mounted to driver arms 36, 36' (see FIGS. 2 and 3) with bolts through holes 48, 48'. By resting vertical blade 12 on platform 44, a collision is virtually impossible between the two blades' cutting edges during blade closure. Whereas extended platform 44 is illustrated as extending perpendicular to the body portion of horizontal blade 40, it is recognized that other configurations holding vertical blade 12 on horizontal blade 40 are possible. As will be understood by those skilled in the art, by supporting one end of vertical blade 12 and allowing or causing the other end of vertical blade 12 to press downwardly, when horizontal blade 40 moves to angularly engage vertical blade 12 and cut film F, the cutting edges 14, 42 are intimately in contact with one another. Such contact also accomplishes a honing action, maintaining blade cutting edge sharpness.

According to the preferred embodiment of the invention, vertical blade 12 is formed with a cutting edge 14 by creating a relief notch 16 thereinto. Horizontal blade 40 is formed with a cutting edge 42. Both cutting edge 14 and cutting edge 42 are formed by an angularly oriented planar surface intersecting a horizontal planar surface of respective horizontal blade 40 or vertical blade 12. When cutting edge 42 is moved so as to pass in intimate contact with cutting edge 14, a precise cutting action occurs.

Figure 2:
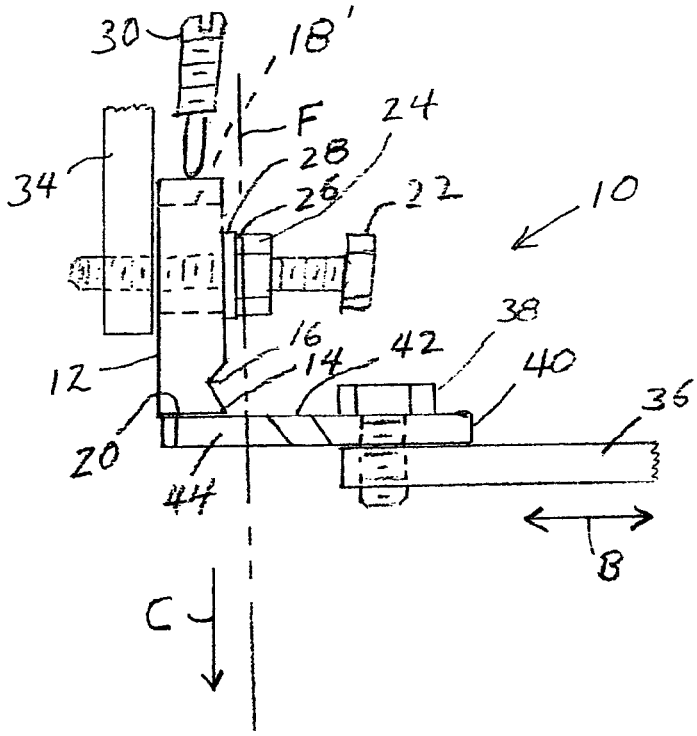
FIG. 2 is a side elevation view of the film cutter of FIG. 1.

Referring now to FIG. 2, the film cutter of the invention is shown in side elevation view. Film F is caused to pass downwardly in the direction of arrow C between cutting edge 14 of vertical blade 12 and cutting edge 42 of horizontal blade 40. Vertical blade 12 is held in sliding relation against support 34 by bolt 22, locking nut 24, spring washer 26 and flat washer 28 to enable movement only in a vertical plane. A particularly effective spring washer 26 is known in the trade as a "wave" washer, configured to apply substantially equal force around its circumference when compressed. When adjusted as described above so as to simply restrict horizontal movement of vertical blade 12, spring washer 26 only makes substantially light, equal contact around its circumference. Horizontal blade 40 is mounted fixedly to driver arm 36 for movement in the direction shown by arrow B in a horizontal plane. Depending on the film to be cut and other operational factors, a single spring plunger 30 is added at one end of vertical blade 12, or, in the alternative, a plurality of spring plungers is added along the length of vertical blade 12. According to the preferred embodiment, spring plunger 30 contacts the end of vertical blade 12 that is distant from support platform 44, i.e. the right end of vertical blade 12 as shown. Control of the degree of pressure between vertical blade 12 and horizontal blade 40 will affect both the cutting capability of the film cutter and the blade service life.

Figure 3:
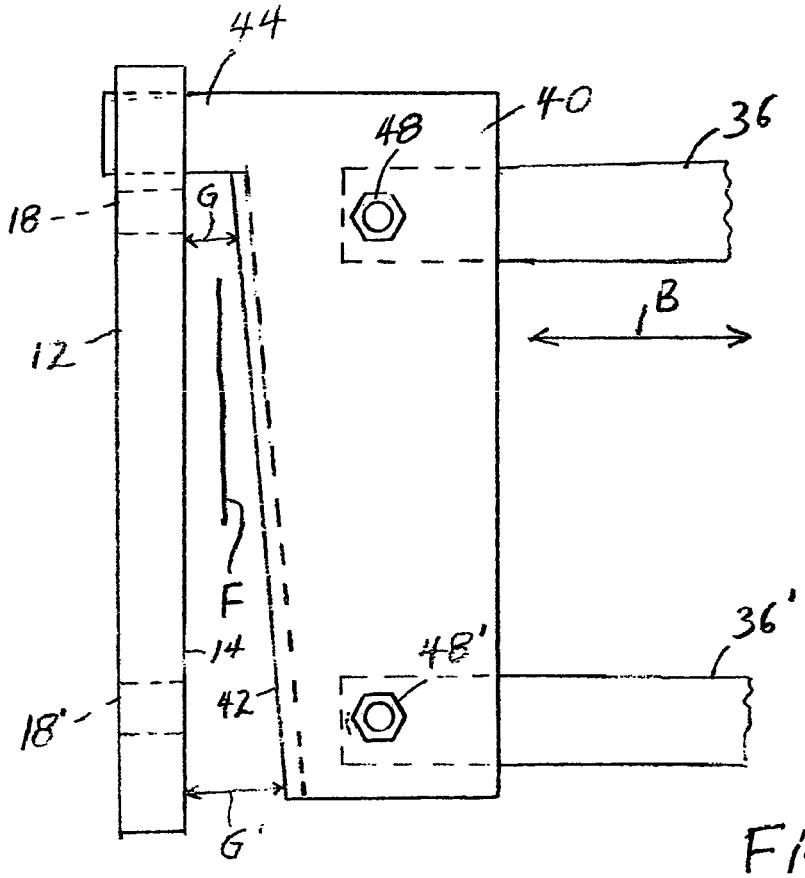
FIG. 3 is a top plan view of the film cutter of FIG. 1.

Referring now to FIG. 3, a top plan view of the invention film cutter is shown with part of vertical blade 12 overlying platform 44 of horizontal blade 40. Horizontal blade 40 is oriented so that cutting edge 42 thereof resides at an angle to vertical blade 12 as illustrated in plan view. The angular relation is characterized by the gap between cutting edge 42 and vertical blade 12 being G at a first end adjacent platform 44 and G' at a second end, G' being larger than G. Horizontal blade 40 is moved toward vertical blade 12 by a driver (not shown) connected to driver arms 36, 36' in the direction indicated by arrow B so that cutting edge 42 fully engages cutting edge 14 of vertical blade 12. Arrow B, as illustrated, is perpendicular to cutting edge 14 of vertical blade 12. With horizontal blade 40 held at a constant angle to vertical blade 12 as horizontal blade 40 is moved in a direction perpendicular to vertical blade 12, the cutting angle is constant, although the cutting intersection moves along the length of the blades.

As described above, the angular relation of cutting edge 42 of horizontal blade 40 to cutting edge 14 of vertical blade 12 causes a shearing cut of film F to produce the desired results. It is recognized that the description of the invention uses the orientational terms "horizontal" and "vertical" in relation to the illustrations provided. However, different position relationships between the cutting blades are contemplated to be within the scope of the invention.

While the present invention is described with respect to specific embodiments thereof, it is recognized that various modifications and variations may be made without departing from the scope and spirit of the invention, which is more clearly and precisely defined by reference to the claims appended hereto.

What is claimed is:

1. A film cutter comprising:

a. a first blade that is movable in a first plane and positioned on a first side of a film path of travel;

b. a second blade that is slidably mounted to be movable in a second plane that is perpendicular to the first plane to maintain substantially floating contact with the first blade, the second blade being positioned on a second side of the film path of travel;

c. the second blade resting against a portion of the first blade;

d. the first blade and the second blade each having a cutting edge that is positioned to contact the other when the first blade is moved in the first plane; and e. the first blade cutting edge and the second blade cutting edge are spaced apart by a smaller distance at a first end than at a second end thereof;

f. whereas the first blade is mounted so as to be moved linearly in a direction perpendicular to the cutting edge of the second blade.

2. The film cutter as described in claim 1, wherein the second blade is formed with a plurality of slots therethrough.

3. The film cutter as described in claim 2, wherein the second blade is slidingly mounted to a support by a plurality of fasteners passing through the plurality of slots.

4. The film cutter as described in claim 3, wherein each of the plurality of fasteners includes resilient retaining means.

5. The film cutter as described in claim 4, wherein the resilient retaining means comprises a spring washer.

6. The film cutter as described in claim 1, further comprising biasing means mounted so as to bias the second blade toward the first blade.

7. The film cutter as described in claim 6, wherein the biasing means comprises a plurality of spring actuated devices.

8. The film cutter as described in claim 1, wherein the first blade comprises a support platform extending outwardly therefrom in a direction to support the second blade.

9. The film cutter as described in claim 8, wherein the platform of the first blade is in contact with the second blade at least between sequential cutting motions.

* * * * *